US009168770B2

(12) United States Patent
Satake

(10) Patent No.: US 9,168,770 B2
(45) Date of Patent: Oct. 27, 2015

(54) ROLL PAPER SUPPLYING DEVICE AND RECORDING APPARATUS

(71) Applicant: SEIKO EPSON CORPORATION, Tokyo (JP)

(72) Inventor: Akihiro Satake, Mikawa-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/341,360

(22) Filed: Jul. 25, 2014

(65) Prior Publication Data

US 2015/0035921 A1 Feb. 5, 2015

(30) Foreign Application Priority Data

Jul. 31, 2013 (JP) ..... 2013-158645

(51) Int. Cl.
*B41J 2/01* (2006.01)
*B41J 15/02* (2006.01)
*B65H 23/18* (2006.01)

(52) U.S. Cl.
CPC ..... *B41J 15/02* (2013.01); *B65H 23/1813* (2013.01)

(58) Field of Classification Search
CPC ..... B41J 11/007; B41J 11/06; B41J 11/0085; B41J 13/103; B41J 11/0065
USPC ..... 347/104, 101
See application file for complete search history.

(56) References Cited

U.S. PATENT DOCUMENTS 3,720,385 A * 3/1973 Staats ..... 242/421.2
5,279,472 A * 1/1994 Hongo et al. ..... 242/422.5
2009/0272838 A1* 11/2009 Kaminaka ..... 242/615.3
2010/0327515 A1* 12/2010 Nakada et al. ..... 271/225

FOREIGN PATENT DOCUMENTS

JP 2012-193032 10/2012

* cited by examiner

*Primary Examiner* — Manish S Shah
*Assistant Examiner* — Yaovi Ameh
(74) *Attorney, Agent, or Firm* — Workman Nydegger

(57) ABSTRACT

A roll paper supplying device and a recording apparatus include an unwinding shaft and a bearing that support a roll having a roll paper wound around a core in a manner that the roll paper can be fed out from the roll, a fixed braking section and a movable braking section that is configured to come into contact with an outer peripheral end face of the roll and brake a rotation of the roll in feeding out of the roll paper, and a radial direction movement section that is configured to move the fixed braking section and the movable braking section in a radial direction of the roll according to a diameter of the roll which decreases as the roll paper is fed out.

10 Claims, 5 Drawing Sheets

ROLL PAPER SUPPLYING DEVICE AND RECORDING APPARATUS

BACKGROUND

1. Technical Field

The invention relates to a roll paper supplying device and a recording apparatus.

2. Related Art

As an example of roll paper supplying device, a paper supplying device which includes a torque limiter connected to a spool shaft for supporting a roll paper is known as disclosed in JP-A-2012-193032. The paper supplying device includes the spool shaft with a flange on which the roll paper is attached, a driven gear provided on one end of the spool shaft, a driving motor that feeds the roll paper in a reverse direction for a start operation, a driving gear provided on an output shaft of the driving motor, and a rotational force driving mechanism disposed between the driving gear and the driven gear. Further, the rotational force driving mechanism is formed by a gear train composed of a plurality of gears. In this gear train, a one-way clutch that allows a power to be transmitted only in reverse rotation of the roll paper, and a torque limiter that brakes the rotation of the roll paper are incorporated. As the roll paper is fed out by a registration roller and a pressure roller, the spool shaft, the driven gear and part of the gear train rotate while applying a back tension to the roll paper fed out via the spool shaft.

In such a paper supplying device, the torque limiter needs to be provided at a position where the roll paper is supported in order to ensure a stable tension to be applied to the roll paper. When the torque limiter is provided at a position where the roll paper is supported, a tension applied to the roll paper changes in inversely proportional to a diameter of the roll regardless of a constant braking torque, since the diameter of the roll gradually decreases as the roll paper is fed out. The tension applied to the roll paper is small when the diameter of the roll is large, and increases as the diameter of the roll becomes small. As a result, a constant tension is not applied to the roll paper.

SUMMARY

An advantage of some aspects of the invention is that a roll paper supplying device capable of applying a constant tension to a roll paper fed out from a roll without providing a torque limiter at a position where the roll paper is supported, and a recording apparatus using the same are provided.

According to a first aspect of the invention, a roll paper supplying device includes a roll support member that supports a roll having a roll paper wound around a core in a manner that the roll paper can be fed out from the roll, a rotation braking section that is configured to come into contact with an outer peripheral end portion of the roll and brake a rotation of the roll in feeding out of the roll paper, and a radial direction movement section that is configured to move the rotation braking section in a radial direction of the roll according to a diameter of the roll which decreases as the roll paper is fed out.

With this configuration, as the roll paper is fed out from the roll, the rotation braking section applies a braking force to the rotating roll when being in contact with the outer peripheral end portion of the roll. As a result, a tension generated by the braking force is applied to the roll paper fed out from the roll. Further, as the diameter of the roll decreases in feeding out of the roll paper, the rotation braking section is moved in the radial direction by the radial direction movement section. As a result, the roll remains in a braking state. Accordingly, a stable and constant tension can be applied to the roll paper since the rotation braking section is constantly in contact with the end portion of the outer periphery of the roll, that is, a position where the roll paper starts to be fed out from the roll. This contributes to prevention of jamming and undulation (skewing) of the roll paper fed out from the roll. Further, there is no need of applying the braking force to the roll via the roll support section.

In the first aspect of the invention, it is preferable that the rotation braking section includes a fixed braking section that is provided so as to come into contact with one end in a width direction of the roll and fixed in an axis direction of the roll, a fixed braking section that is provided so as to come into contact with one end in a width direction of the roll and fixed in an axis direction of the roll, and a holding biasing section that biases the movable braking section to hold the roll between the fixed braking section and the movable braking section.

With this configuration, the roll can remain in contact with the fixed braking section and the movable braking section since the roll is held by the fixed braking section and the movable braking section of the rotation braking section via the holding biasing section. Accordingly, a stable braking force can be applied to the roll.

In the first aspect of the invention, it is preferable that the fixed braking section and the movable braking section each include a torque limiter which includes a roller that comes into rolling contact with an outer peripheral end face of the roll.

With this configuration, the braking force can be applied to the roll without loss since the braking torque of the torque limiter is transmitted to the roll via the roller. That is, a stable braking force can be applied to the roll since the braking force applied to the roll does not need a friction with the roll.

In the first aspect of the invention, it is preferable that the roller includes a first roller that comes into rolling contact with the outer peripheral end face of the roll, and a second roller that comes into rolling contact with an outer peripheral surface of the roll, the second roller having a diameter larger than a diameter of the first roller.

With this configuration, a small-diameter roller can come into rolling contact with the outer peripheral end face of the roll at a specified position. That is, the braking force can be applied to the roll at the position where the roll paper starts to be fed out from the roll while the diameter of the roll gradually decreases, and a stable and constant tension can be applied to the roll paper. Further, in addition to the small-diameter roller, a large-diameter roller comes into contact with the outer peripheral surface of the roll. Accordingly, a loss of the braking force due to slippage or the like can be avoided.

In the first aspect of the invention, it is preferable that the rotation braking section further includes a brake support member that supports the fixed braking section and the movable braking section, the radial direction movement section includes a radial direction guide that supports the brake support member in a manner slidable in upper and lower radial directions, and the rotation braking section is guided by the radial direction guide and moves in the radial direction by a weight of the rotation braking section.

With this configuration, the radial direction movement section that is configured to move the rotation braking section in a radial direction of the roll according to the decreasing diameter of the roll can be achieved with a simple configuration. Further, the rotation braking section can be configured to easily follow the decreasing diameter of the roll.

In the first aspect of the invention, it is preferable that the roll support member includes a support shaft on which the core of the roll is fixed, and a bearing that pivotally supports the support shaft in a manner rotatable and axially slidable.

With this configuration, when the roll has deviation in winding in the axis direction, the roll itself can be finely moved in the axis direction taking the fixed braking section and the movable braking section as a positional reference. Accordingly, occurrence of a loss such as slippage becomes less likely, and the braking force can be appropriately applied to the roll. Further, even if the roll has deviation in winding, the roll paper can be fed out taking the fixed braking section and the movable braking section as a positional reference. That is, the fixed braking section and the movable braking section can work as a feeding guide of the roll paper in the width direction. Accordingly, undulation (skewing) of the roll paper due to deviation in winding of the roll can be prevented.

According to second aspect of the invention, a recording apparatus includes a roll support member that supports a roll having a roll paper wound around a core in a manner that the roll paper can be fed out from the roll, a rotation braking section that is configured to come into contact with an outer peripheral end face of the roll and brake a rotation of the roll in feeding out of the roll paper, a radial direction movement section that is configured to move the rotation braking section in a radial direction of the roll according to a diameter of the roll which decreases as the roll paper is fed out, a recording section that performs a recording operation on the roll paper fed out from the roll, and a winding unit that winds up the roll paper into a roll shape after the recording operation.

With this configuration, undulation (skewing) of the roll paper fed from the roll to the recording section can be prevented since a constant tension can be applied to the roll paper fed out from the roll with a relatively simple configuration. Accordingly, recording can be performed with high precision in a predetermined area of the roll paper since the jamming of the roll paper is reduced and the position in the width direction of the roll paper is not easily displaced. Further, the roll paper after the recording operation can be stably and appropriately wound up by the winding unit since the position in the width direction of the roll paper relative to the winding position is not easily displaced.

In the second aspect of the invention, it is preferable that the rotation braking section includes a fixed braking section that is provided so as to come into contact with one end face in a width direction of the roll and fixed in an axis direction of the roll, a movable braking section that is provided so as to come into contact with the other end face in a width direction of the roll and movable in the axis direction of the roll, and a holding biasing section that biases the movable braking section to hold the roll between the fixed braking section and the movable braking section.

In the second aspect of the invention, it is preferable that the fixed braking section and the movable braking section each include a torque limiter which includes a roller that comes into rolling contact with an outer peripheral end face of the roll.

Further, in the second aspect of the invention, it is preferable that the roller includes a first roller that comes into rolling contact with the outer peripheral end face of the roll, and a second roller that comes into rolling contact with an outer peripheral surface of the roll, the second roller having a diameter larger than a diameter of the first roller.

In the second aspect of the invention, it is preferable that the rotation braking section further includes a brake support member that supports the fixed braking section and the movable braking section, the radial direction movement section includes a radial direction guide that supports the brake support member in a manner slidable in upper and lower radial directions, and the rotation braking section is guided by the radial direction guide and moves in the radial direction by a weight of the rotation braking section.

In the second aspect of the invention, it is preferable that the roll support member includes a support shaft on which the core of the roll is fixed, and a bearing that pivotally supports the support shaft in a manner rotatable and axially slidable.

BRIEF DESCRIPTION OF THE DRAWINGS

The invention will be described with reference to the accompanying drawings, wherein like numbers reference like elements.

DESCRIPTION OF EXEMPLARY EMBODIMENTS

A roll paper supplying device according to one embodiment of the invention and a recording apparatus having the same will be described below with reference to the accompanying drawings. The recording apparatus of this embodiment is an ink jet type apparatus that performs printing (recording) of a desired image or the like on a sheet of roll paper which is supplied and removed in a roll-to-roll fashion by the roll paper supplying device. In the following description, a direction in which the roll paper is fed is referred to as X axis direction, and a direction perpendicular to the X direction is referred to as Y direction.

Figure 1:
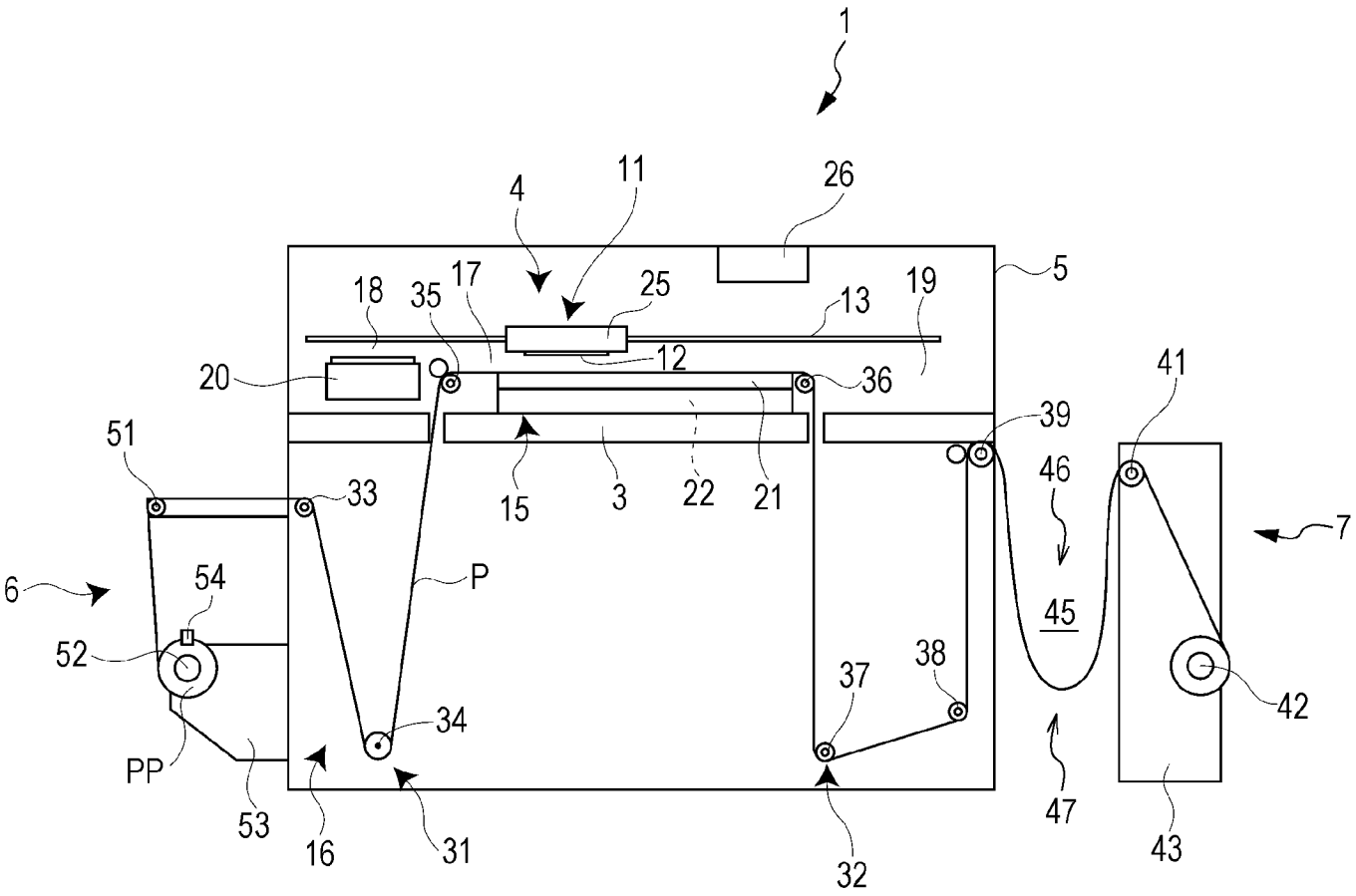
FIG. 1 is a schematic side view of a recording apparatus according to an embodiment.
Figure 2:
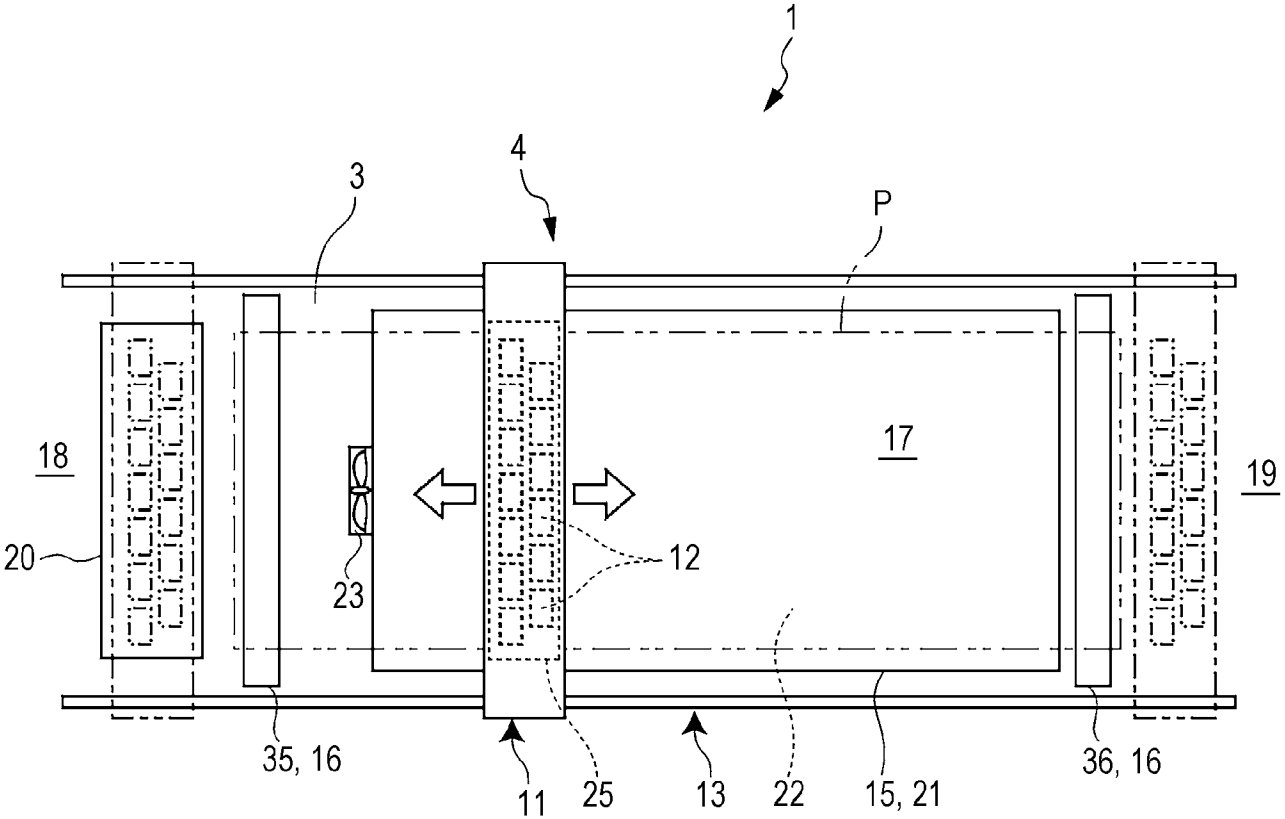
FIG. 2 is a schematic plan view of a main part of the recording apparatus according to the embodiment.

FIG. 1 is a side view of the recording apparatus and FIG. 2 is a plan view of a main part of the recording apparatus. As shown in FIGS. 1 and 2, a recording apparatus 1 includes a machine base 2 having a base plate 3 on the upper surface, a printing section 4 (recording section) disposed above the machine base 2 to perform printing on a roll paper P, a safety cover 5 which is disposed above the machine base 2 and covers the printing section 4, an unwinding unit 6 that unwinds and supplies the roll paper P to the printing section 4, and a winding unit 7 that winds up the roll paper P fed out from the printing section 4. The roll paper P is fed out from a roll PP having the roll paper P wound around a core PC in the unwinding unit 6 (see FIG. 3) and is wound up around the core PC in the winding unit 7.

The printing section 4 includes a carriage unit 11 which includes a plurality of recording heads 12 composed of ink jet heads, an X axis table 13 that allows the carriage unit 11 to move in the X axis direction which is a feeding direction of the roll paper P, an Y axis table (not shown in the figure) which is mounted on the X axis table 13 and allows the carriage unit 11 to finely move in the Y axis direction, a platen 15 that is disposed on the base plate 3 so as to face the carriage unit 11, and a paper feeding mechanism 16 that feeds the roll paper P from the unwinding unit 6 to the platen 15 (paper supply) while feeding the roll paper P from the platen 15 to the winding unit 7 (paper output). The roll paper supplying device is composed of the unwinding unit 6, the paper feeding mechanism 16, and the winding unit 7.

The entire upper surface of the platen 15 is a printing area 17 in which printing is performed by the printing section 4. A maintenance area 18 and a working area 19 are provided on the base plate 3 on the upstream side and downstream side of the printing area 17, respectively. A maintenance mechanism 20 which includes a suction unit, a wiping unit and the like for maintaining the recording heads 12 is disposed in the maintenance area 18. The working area 19 is used for exchange operation of the recording heads 12 or the like by an operator.

The platen 15 includes a suction plate 21 having a plurality of suction ports (not shown in the figure) for suctioning the roll paper P, a suction chamber 22 provided under the suction plate 21, and a suction fan 23 provided on one end of the suction chamber 22. The suction fan 23 is driven in synchronization with the paper feeding mechanism 16 so that it is turned on to suction the roll paper P onto the suction plate 21 when the paper feeding mechanism 16 is not in operation, while it is turned off to allow the roll paper P to be fed when the paper feeding mechanism 16 is in operation.

The carriage unit 11 includes the plurality of recording heads 12 and a carriage 25 that holds the plurality of recording heads 12. The recording heads 12 include a plurality of nozzle rows of different colors each of which forms one print line so as to perform color printing by ejecting ink of different colors. A valve unit 26 is mounted on the safety cover 5 so that ink of different colors is supplied from an ink tank, which is not shown in the figure, through the valve unit 26 to the plurality of recording heads 12.

In the printing section 4, the recording heads 12 mounted on the carriage unit 11 perform a desired printing by selectively ejecting ink onto the roll paper P which is supplied from the unwinding unit 6 and is suctioned onto the platen 15 while moving in the X and Y directions by the X axis table 13 and the Y axis table. When printing is finished, the printed portion of the roll paper P (a portion in the printing area 17) is fed downstream (to the winding unit 7), and an unprinted portion of the roll paper P is supplied to the platen 15. That is, in the printing section 4 of this embodiment, printing of the portion of the roll paper P on the platen 15 which is located in the printing area 17 and feeding of the portion of the roll paper P which is located in the printing area 17 are alternately and intermittently performed.

The paper feeding mechanism 16 includes a group of paper supply rollers 31 and a group of paper output rollers 32 which are disposed on the upstream side and the downstream side of the platen 15, respectively. The group of paper supply rollers 31 are disposed in the machine base 2 under the maintenance area 18 so that a long feeding path for the roll paper P can be ensured (by forming the feeding path with curvature) from the unwinding unit 6 to the platen 15 while preventing the feeding path from interfering with the maintenance area 18. The group of paper output rollers 32 are disposed in the machine base 2 under the working area 19 so that a long feeding path for the roll paper P can be ensured from the platen 15 to the winding unit 7 while preventing the feeding path from interfering with the working area 19.

The group of paper supply rollers 31 include a first paper supply roller 33 that directs the roll paper P fed from the unwinding unit 6 downward in the machine base 2, and a second paper supply roller 34 that is located downstream to the first roller 33 and directs the roll paper P upward, and a paper supply roller 35 that is located downstream to the second paper supply roller 34 and upstream to the vicinity of the platen 15 and feed the roll paper P to the platen 15.

The first paper supply roller 33 and the second paper supply roller 34 are free rollers and the paper supply roller 35 is a motor-driven nip roller. During feeding of the roll paper P from the unwinding unit 6 to the platen 15 through the V-shaped feeding path by the drive of the paper supply roller 35, the undulation of the roll paper P is corrected.

Further, the group of paper output rollers 32 include a first paper output roller 36 that is located downstream to the vicinity of the platen 15 and directs the roll paper P fed from the platen 15 downward, and a second paper output roller 37 that is located downstream to the first paper output roller 36 and directs the roll paper P in a substantially parallel direction, and a third paper output roller 38 that is located downstream to the second paper output roller 37 and directs the roll paper P upward, and a paper output roller 39 that is located downstream to the third paper supply roller 38 and feed the roll paper P to the winding unit 7.

The first paper output roller 36, the second paper output roller 37 and the third paper output roller 38 are free rollers and the paper output roller 39 is a motor-driven nip roller. The paper output roller 39 is driven in synchronization with the paper supply roller 35. During feeding of the roll paper P from the platen 15 to the winding unit 7 through the U-shaped feeding path by the drive of the paper output roller 39, the undulation of the roll paper P is corrected.

In the paper feeding mechanism 16, when printing of a unit printing portion of the roll paper P on the platen 15 which is located in the printing area 17 is finished, the paper supply roller 35 and the paper output roller 39 are synchronized and rotate. Accordingly, the unit printing portion of the roll paper P is fed into the platen 15 on the upstream side of the platen 15 with a back tension being applied to the roll paper P. Further, the unit printing portion of the roll paper P is fed out from the platen 15 on the downstream side of the platen 15 with a forward tension being applied to the roll paper P.

Although not shown in the figure, a width guide that regulates the position of the roll paper P in the width direction is provided on the platen 15. Moreover, the paper supply roller 35 and the paper output roller 39 are controlled by an encoder or the like so that the roll paper P is fed with high precision. Accordingly, the roll paper P is supplied to the platen 15 with high positional precision and is suctioned to the platen 15 in a flat state. This allows a paper gap to be maintained with high precision and high quality printing to be performed.

The winding unit 7 includes an intermediate winding roller 41 which faces the paper output roller 39, a winding shaft 42 that winds up the roll paper P fed via the intermediate winding roller 41 into a roll shape, and a winding frame 43 that supports the intermediate winding roller 41 and the winding shaft 42. A motor which is not shown in the figure is connected to the winding shaft 42 so that the winding shaft 42 winds up the roll paper P by driving the motor.

Further, a buffer section 45 is provided between the machine base 2 and the winding unit 7. The roll paper P fed out from the paper output roller 39 sags under its weight at the buffer section 45 and is then wound up by the winding shaft 42 via the intermediate winding roller 41. An upper limit sensor 46 and a lower limit sensor 47 for detecting the roll paper P are provided in the buffer section 45. When the lower limit sensor 47 detects the roll paper P, the winding shaft 42 starts winding of the roll paper P. After that, when the upper limit sensor 46 detects the roll paper P, the winding shaft 42 terminates winding of the roll paper P.

Accordingly, the winding unit 7 intermittently winds up the roll paper P which is buffered by forming a sag at the buffer section 45. That is, the unit printing portions of the roll paper P are intermittently fed out from the platen 15 by the paper feeding mechanism 16 and are subsequently stored in the buffer section 45. The roll paper P stored in the buffer section 45 is sensed and wound up around the winding shaft 42 as appropriate.

The unwinding unit 6 includes an intermediate unwinding roller 51 which faces the first paper supply roller 33, an unwinding shaft 52 that unwinds the roll paper P from the roll PP to the intermediate unwinding roller 51, and an unwinding frame 53 that supports the intermediate unwinding roller 51 and the unwinding shaft 52. The roll PP having the roll paper P wound around a core PC (paper tube) is mounted on the unwinding shaft 52, and the roll paper P is unwound from the roll PP via the group of paper supply rollers 31 by driving the paper supply roller 35.

Further, a braking unit 54 is provided in the unwinding unit 6 so as to apply a tension (back tension) to the roll paper P fed out from the unwinding unit 6 (the details will be described later). The braking unit 54 brakes the rotation of the roll PP by coming into contact with the roll PP and applies a tension to the roll paper P fed out from the unwinding unit 6. This prevents undulation of the roll paper P fed out from the unwinding unit 6, and the inertia of the roll PP prevents a slip rotation.

Figure 3:
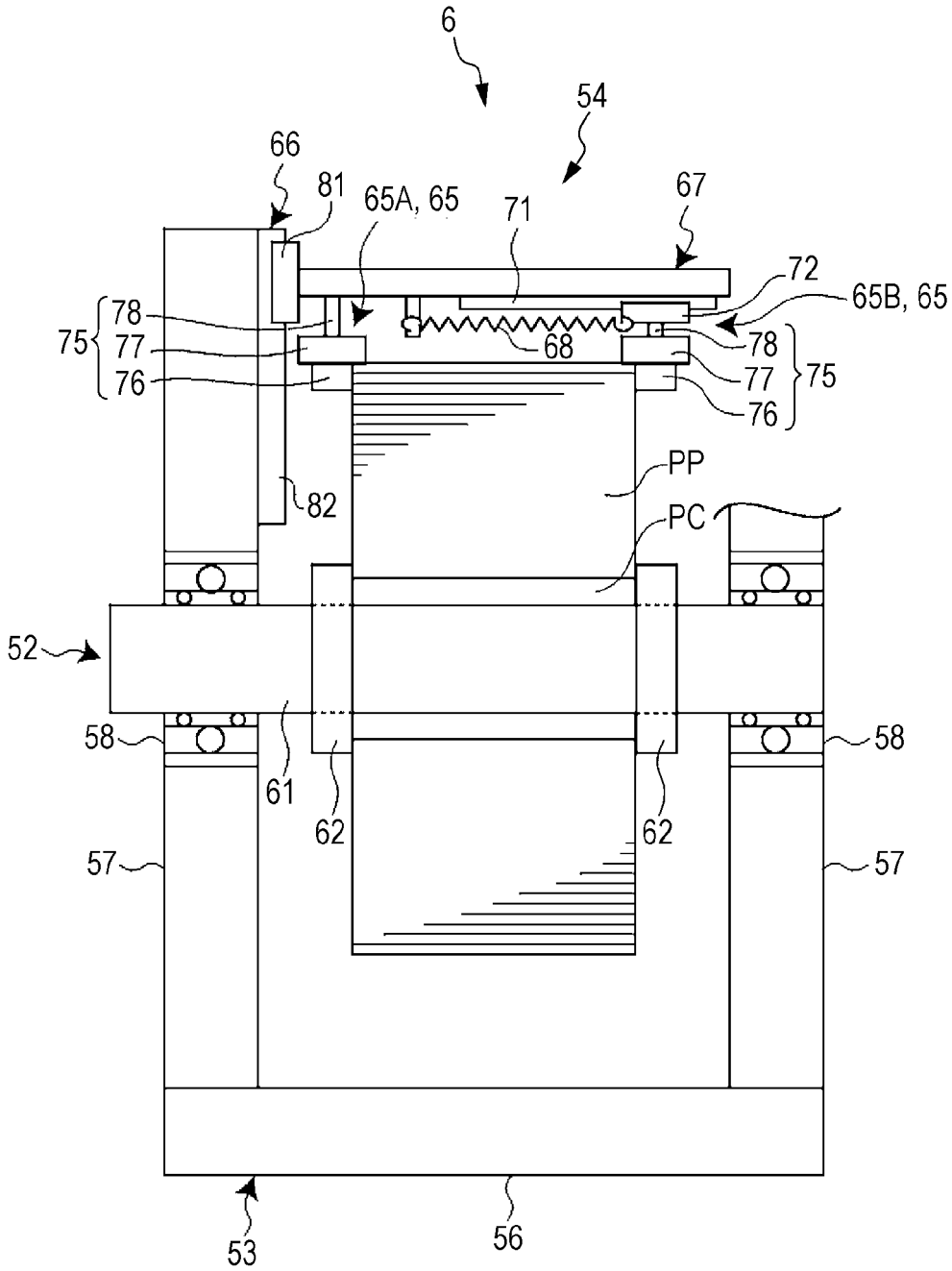
FIG. 3 is a front view of an unwinding shaft of an unwinding unit and around a braking unit.
Figure 4:
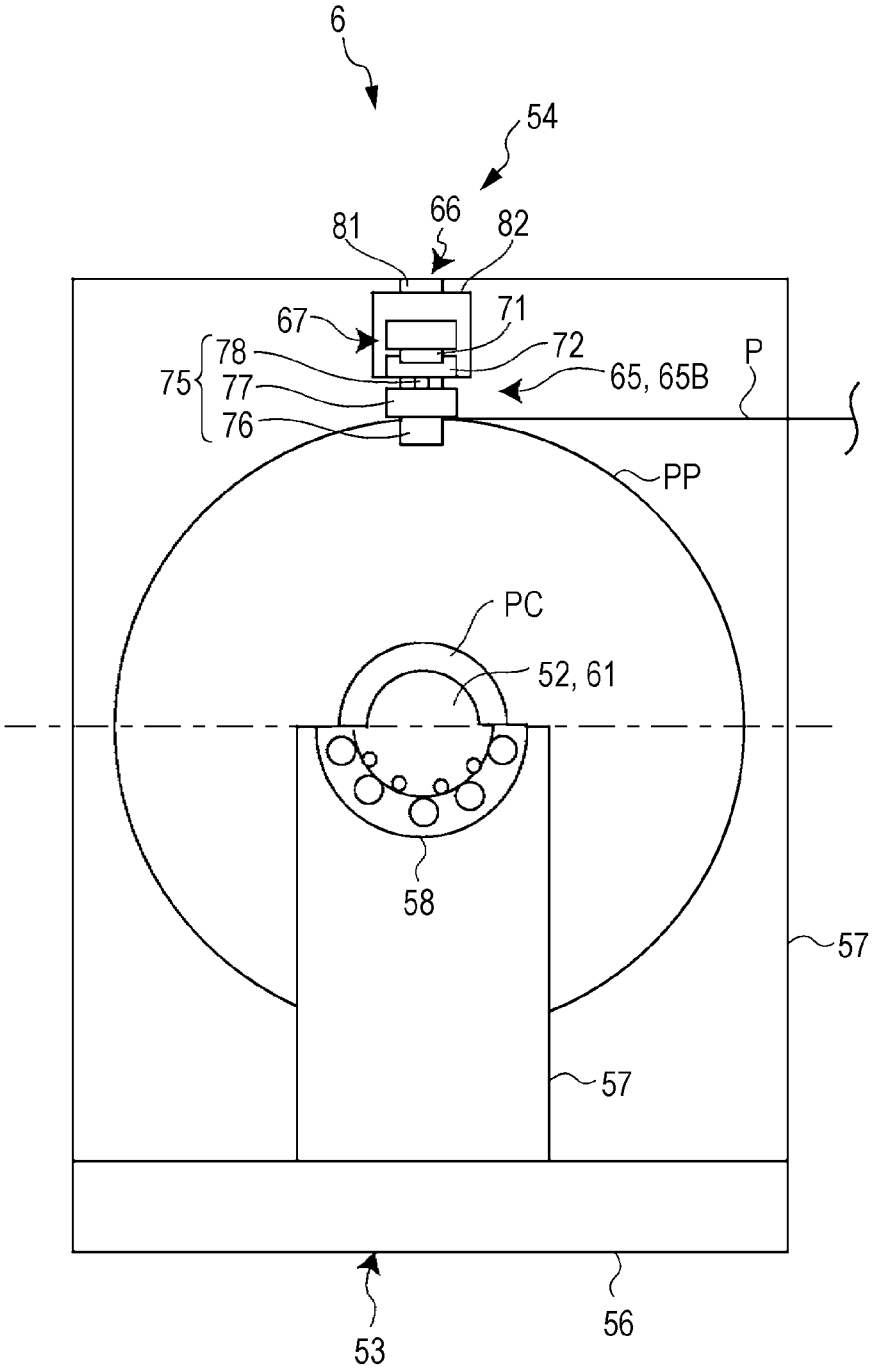
FIG. 4 is a side view of the unwinding shaft of the unwinding unit and around the braking unit.

With reference to the front view of FIG. 3 and the side view of FIG. 4, a configuration of the unwinding shaft 52 in the unwinding unit 6 and around the braking unit 54 will be described in detail. As described above, the unwinding frame 53 is provided in the unwinding unit 6, and the unwinding shaft 52 (support shaft) is rotatably supported by the unwinding frame 53. The unwinding frame 53 includes a base frame 56 and two side frames 57 that stand on the base frame 56, and the unwinding shaft 52 is supported by the two side frames 57 via bearings 58. The braking unit 54 that brakes the rotation of the roll PP is mounted on one side frame 57.

The unwinding shaft 52 is composed of a shaft body 61 and two fixation rings 62 that are mounted on the shaft body 61. The roll PP is fixed to the shaft body 61 by narrowing the width between the two fixation rings 62. Although simplified in the figure, each fixation ring 62 is formed in a truncated cone shape and can be fixed at any position on the shaft body 61. The two fixation rings 62 are mounted on the shaft body 61 with their tapered portions facing each other. When the two fixation rings 62 are moved toward each other to the position of the roll PP mounted on the shaft body 61 so as to engage with the core PC of the roll body PP, the roll PP is fixed to the shaft body 61.

Although the unwinding shaft 52 of this embodiment is supported by the unwinding frame 53 on its both ends, the unwinding shaft 52 can be supported by a cantilever support. Further, any fixation structure can be used to fix the roll PP to the unwinding shaft 52. For example, the core PC of the roll body PP can be held by two rings, or alternatively, the core PC can be fixed by using a key or the like.

The bearing 58 is formed, for example, by a rotary ball spline which serves as a ball bearing and a ball spline. That is, the unwinding shaft 52 is supported rotatable to the two side frames 57 and slidable in the axis direction via the rotary ball spline. When the roll paper P is unwound, the roll PP rotates along with the unwinding shaft 52. Further, when regulation in the width direction is applied by a rotation braking section 65 which is described later, the roll PP finely moves in the axis direction along with the unwinding shaft 52. In addition, the bearing 58 may also be formed by a ball bearing and a ball spline.

The braking unit 54 includes the rotation braking section 65 that is configured to come into contact with the outer peripheral end face of the roll PP and brake the rotation of the roll PP, and a radial direction movement section 66 that is configured to move the rotation braking section 65 in the radial direction of the roll PP according to the decreasing diameter of the roll PP. In this case, the rotation braking section 65 brakes the rotation of the roll PP and applies a tension (back tension) to the roll paper P which is fed out from the roll PP. As the roll paper P is fed out from the roll PP, the diameter of the roll PP gradually decreases. Accordingly, the radial direction movement section 66 moves the rotation braking section 65 in the radial direction of the roll PP so as to follow the decreasing diameter of the roll PP while maintaining the braking function.

The rotation braking section 65 includes a fixed braking section 65A that comes into contact with one (left in the figure) of the outer peripheral end faces of the roll PP, a movable braking section 65B that comes into contact with the other (right in the figure) of the outer peripheral end faces of the roll PP, and a brake support member 67 that supports the fixed braking section 65A and the movable braking section 65B from the upper side. The fixed braking section 65A is fixed to the brake support member 67, while the movable braking section 65B is slidably supported by the brake support member 67. The movable braking section 65B is biased by a holding biasing section 68 so as to hold the roll PP between the movable braking section 65B and the fixed braking section 65A.

The fixed braking section 65A serves as a positional reference in the width direction (paper width direction) of the roll paper P which is fed out from the roll PP, and is disposed at a position which corresponds to one end of the paper transportation path of the paper feeding mechanism 16. Accordingly, the roll paper P is fed out from the roll PP with high positional precision in the width direction. For example, even if the roll PP has deviation in winding, the position in the axis direction of the roll PC itself is regulated by the fixed braking section 65A and the movable braking section 65B, thereby preventing the unwinding position of the roll paper P in the width direction from being changed. The fixed braking section 65A is preferably mounted on the brake support member 67 so that the position of the fixed braking section 65A can be adjusted in the axis direction (Y axis direction).

An axis direction guide 71 extending in the Y axis direction is provided on the brake support member 67, and the movable braking section 65B is fixed to an axis direction slider 72 that slidably engages with the axis direction guide 71. That is, the movable braking section 65B is configured to be slidable in the direction (axis direction) in which the movable braking section 65B holds and releases the roll PP. The holding biasing section 68 is formed, for example, by a coil spring having a long spring stroke. One end of the coil spring is hooked on the brake support member 67, while the other end is hooked on the axis direction slider 72. This causes the movable braking section 65B to be biased toward the fixed braking section 65A, and the outer periphery of the roll PP is held by the movable braking section 65B and the fixed braking section 65A.

The fixed braking section 65A has the same configuration as that of the movable braking section 65B, and the following description is provided by way of example of the configuration of the fixed braking section 65A. The fixed braking section 65A is formed by a torque limiter having a roller 75 that comes into rolling contact with the outer peripheral end face of the roll PP. More specifically, the fixed braking section 65A includes a small-diameter roller 76 that comes into rolling contact with the outer peripheral end face of the roll PP, a large-diameter roller 77 that comes into rolling contact with the outer peripheral surface of the roll PP, and a roller shaft 78 that supports the small-diameter roller 76 and the large-diameter roller 77 in a rotatable manner, and a braking mechanism (not shown in the figure) which is incorporated in the small-diameter roller 76 and the large-diameter roller 77.

The roller shaft 78 of the fixed braking section 65A is fixed to the brake support member 67, while the roller shaft 78 of the movable braking section 65B is fixed to the axis direction slider 72. The small-diameter rollers 76 of the fixed braking section 65A and the movable braking section 65B come into rolling contact with the outer peripheral end face of the roll PP and transmit the braking force of the braking mechanism to the roll PP to brake the rotation of the roll PP. Further, the large-diameter rollers 77 come into rolling contact with the outer peripheral surface of the roll PP and transmit the braking force of the braking mechanism while aligning the position of the rotation braking section 65 to the decreasing diameter of the roll PP.

Accordingly, in this embodiment, a stable braking force can be applied without being effected by paper quality or the like of the roll PP since braking is not performed by friction between the roll PP and the the fixed braking section 65A or the movable braking section 65B. In addition, in order to accurately transmit the braking force to the roll PP, the small-diameter roller 76 (and the large-diameter roller 77) needs not to slip rotate. Accordingly, of the small-diameter roller 76 and the large-diameter roller 77, at least the small-diameter roller 76 is preferably a rubber roller or a rubber lining roller. Further, the small-diameter roller 76 is preferably formed in a flat shape in order to remain in rolling contact with the roll PP even if the diameter of the roll PP significantly decreases. Moreover, the small-diameter roller 76 is preferably formed integrally with the large-diameter roller 77.

The radial direction movement section 66 includes a radial direction slider 81 that supports the brake support member 67 in a cantilever manner, and a radial direction guide 82 that is fixed to one of the side frames 57 and extends in the vertical direction. The radial direction guide 82 is disposed on a line extending in the vertical direction from the axis center of the unwinding shaft 52, and the rotation braking section 65 is guided by the radial direction guide 82 and moves in the radial direction by a weight of the rotation braking section 65. That is, the rotation braking section 65 moves to the decreasing diameter of the roll PP so that the two large-diameter rollers 77 are constantly in contact with the outer peripheral surface of the roll PP.

The radial direction guide 82 may not necessarily extend in the vertical direction. In the case where there is no space for positioning the rotation braking section 65 above the roll PP due to the space occupied by the unwinding unit 6, it is not possible to move the rotation braking section 65 by using its weight. In such a case, it is preferable that a sensor for detecting the diameter of the roll PP and a movement mechanism (for example, a combination of a motor and a lead screw mechanism) are further provided so that the movement mechanism is actuated based on the detection result to move the rotation braking section 65 (to follow the diameter of the roll PP).

In the braking unit 54 having the above configuration, when the roll paper P is fed out from the roll PP by the paper feeding mechanism 16, the fixed braking section 65A and the movable braking section 65B which are in contact with the outer peripheral end face of the roll PP brake the rotation of the roll PP. Since the fixed braking section 65A and the movable braking section 65B are provided to hold the roll PP from the both sides, an uniform and constant braking force is applied to the roll PP from the both sides. In addition to that, since the fixed braking section 65A and the movable braking section 65B follow the decreasing diameter of the roll PP by using their weight, a constant back tension can be applied to the roll paper P fed out from the roll PP.

In addition, the fixed braking section 65A and the movable braking section 65B can maintain the position where the roll paper P starts to be fed out constant in the width direction, thereby allowing the roll paper P to be fed out from the roll PP with high positional precision. Accordingly, jamming and undulation of the roll paper P fed out from the roll PP can be efficiency prevented by cooperation of the precision in feeding out and the back tension.

Figure 5:
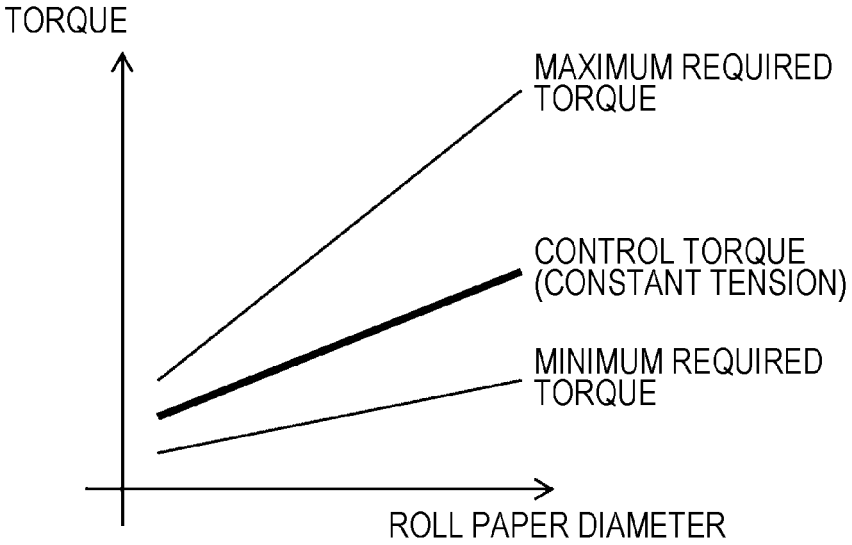
FIG. 5 is a diagram of a roll diameter and a torque at the unwinding shaft.

FIG. 5 shows a relationship between a control torque (braking torque) of the unwinding shaft 52 and a roll diameter of the roll PP. In FIG. 5, a "minimum required torque" is a braking torque which corresponds to a minimum back tension required for the roll paper P being appropriately fed (without undulation). Further, a "maximum required torque" is a braking torque which corresponds to a back tension at the limit for slippage of the paper feeding roller 35. The braking torque applied by the braking unit 54 of this embodiment ("control torque") is set to be substantially an intermediate value between the "minimum required torque" and the "maximum required torque".

It is obvious that the back tension applied to the roll paper P is constant since the "braking torque" shown in the figure is a braking torque applied to the unwinding shaft 52 and is proportional to the diameter of the roll. That is, even if the diameter of the roll PP changes, a constant tension can be constantly applied to the roll paper P fed out from the roll PP. The amount of the "minimum required torque" and the "maximum required torque" varies depending on the paper quality, the thickness or the like of the roll paper P. Accordingly, it is preferable that the braking force (of the braking mechanism) of the fixed braking section 65A and the movable braking section 65B is adjustable.

According to this embodiment, a constant tension can be applied with a simple configuration to the roll paper P fed out from the roll PP. Further, the roll paper P can be fed out with high precision in the paper width direction. Accordingly, jamming or undulation of the roll paper P fed into the printing section 4 can be effectively prevented. The roll paper supplying device of the invention is not limited to the roll-to-roll feeding system as described in the above embodiment, and can be applied to a feeding system in the paper output area in which the roll paper is cut per unit printing portion.

The entire disclosure of Japanese Patent Application No. 2013-158645, filed Jul. 31, 2013 is expressly incorporated by reference herein.

What is claimed is:

1. A roll paper supplying device comprising:

a roll support member that supports a roll having a roll paper wound around a core in a manner that the roll paper can be fed out from the roll;

a rotation braking section that is configured to come into rolling contact with an outer peripheral end portion of the roll and brake a rotation of the roll in feeding out of the roll paper; and a radial direction movement section that is configured to move the rotation braking section in a radial direction of the roll according to a diameter of the roll which decreases as the roll paper is fed out, wherein the rotation braking section comprises;

a fixed braking section that is provided so as to come into rolling contact with one end in a width direction of the roll and fixed in an axis direction of the roll;

a movable braking section that is provided so as to come into rolling contact with the other end in the width direction of the roll and movable in the axis direction of the roll; and a holding biasing section that biases the movable braking section to hold the roll between the fixed braking section and the movable braking section.

2. The roll paper supplying device according to claim 1, wherein the fixed braking section and the movable braking section each comprising:

a torque limiter which includes a roller that comes into rolling contact with an outer peripheral end face of the roll.

3. The roll paper supplying device according to claim 2, wherein the roller comprising:

a first roller that comes into rolling contact with the outer peripheral end face of the roll; and a second roller that comes into rolling contact with an outer peripheral surface of the roll, the second roller having a diameter larger than a diameter of the first roller.

4. The roll paper supplying device according to claim 1, wherein the rotation braking section further includes a brake support member that supports the fixed braking section and the movable braking section, the radial direction movement section includes a radial direction guide that supports the brake support member in a manner slidable in upper and lower radial directions, and the rotation braking section is guided by the radial direction guide and moves in the radial direction by a weight of the rotation braking section.

5. The roll paper supplying device according to claim 1, wherein the roll support member comprising:

a support shaft on which the core of the roll is fixed; and a bearing that pivotally supports the support shaft in a manner rotatable and axially slidable.

6. A recording apparatus comprising:

a roll support member that supports a roll having a roll paper wound around a core in a manner that the roll paper can be fed out from the roll;

a rotation braking section that is configured to come into rolling contact with an outer peripheral end face of the roll and brake a rotation of the roll in feeding out of the roll paper;

a radial direction movement section that is configured to move the rotation braking section in a radial direction of the roll according to a diameter of the roll which decreases as the roll paper is fed out;

a recording section that performs a recording operation on the roll paper fed out from the roll; and a winding unit that winds up the roll paper into a roll shape after the recording operation, wherein the rotation braking section comprises:

a fixed braking section that is provided so as to come into rolling contact with one end face in a width direction of the roll and fixed in an axis direction of the roll;

a movable braking section that is provided so as to come into rolling contact with the other end face in the width direction of the roll and movable in the axis direction of the roll; and a holding biasing section that biases the movable braking section to hold the roll between the fixed braking section and the movable braking section.

7. The recording apparatus according to claim 6, wherein the fixed braking section and the movable braking section each comprising:

a torque limiter which includes a roller that comes into rolling contact with an outer peripheral end face of the roll.

8. The recording apparatus according to claim 7, wherein the roller comprising:

a first roller that comes into rolling contact with the outer peripheral end face of the roll; and a second roller that comes into contact with an outer peripheral surface of the roll, the second roller having a diameter larger than a diameter of the first roller.

9. The recording apparatus according to claim 6, wherein the rotation braking section further includes a brake support member that supports the fixed braking section and the movable braking section, the radial direction movement section includes a radial direction guide that supports the brake support member in a manner slidable in upper and lower radial directions, and the rotation braking section is guided by the radial direction guide and moves in the radial direction by a weight of the rotation braking section.

10. The recording apparatus according to claim 6, wherein the roll support member comprising:

a support shaft on which the core of the roll is fixed; and a bearing that pivotally supports the support shaft in a manner rotatable and axially slidable.

* * * * *